United States Patent [19]

Griego et al.

[11] Patent Number: 4,466,616

[45] Date of Patent: Aug. 21, 1984

[54] TARGET APPARATUS

[76] Inventors: Arthur G. Griego; Randy T. Griego; George A. Griego, Jr., all of 8901 Central NE. Space 3, Albuquerque, N. Mex. 87123

[21] Appl. No.: 445,666

[22] Filed: Nov. 30, 1982

[51] Int. Cl.[3] ..... A63B 63/00

[52] U.S. Cl. ..... 273/384

[58] Field of Search ..... 273/384, 385

[56] References Cited

U.S. PATENT DOCUMENTS 1,021,019 3/1912 Van Kannel ..... 273/384

2,202,738 5/1940 Keller ..... 273/384

*Primary Examiner*—Anton O. Oechsle

*Attorney, Agent, or Firm*—Schwartz & Weinrieb

[57] ABSTRACT

A missile responsive amusement apparatus comprising a target mounted upon one end of an elongated target arm, the latter being pivotally mounted to a box-like frame, whereupon when a missile strikes the target, the target arm pivots in a direction causing its other end to engage and rotate a latch bar for lifting latching teeth out of notches located in a pair of spindle cams, thereby releasing a spindle bar to which a seat is attached for rotation in a direction causing the seat to swivel downward for dropping a person sitting thereupon into a tank of water below the seat. Thereafter, via spring biasing of the spindle cams and target arm, the apparatus can be reset by rotating the seat upward until it latches in its upright position via the latching teeth engaging the notches of the spindle cams attached to the spindle bar, while concurrently causing the latching bar to rotate for pivoting the target arm back to its "cocked" or "ready" position.

21 Claims, 12 Drawing Figures

FIG. 4
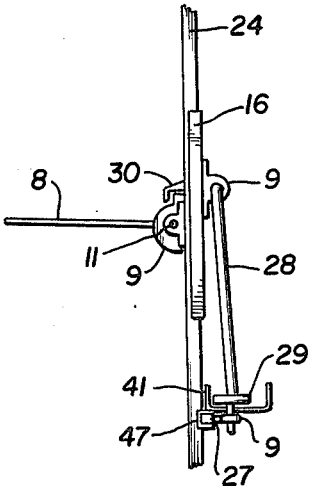
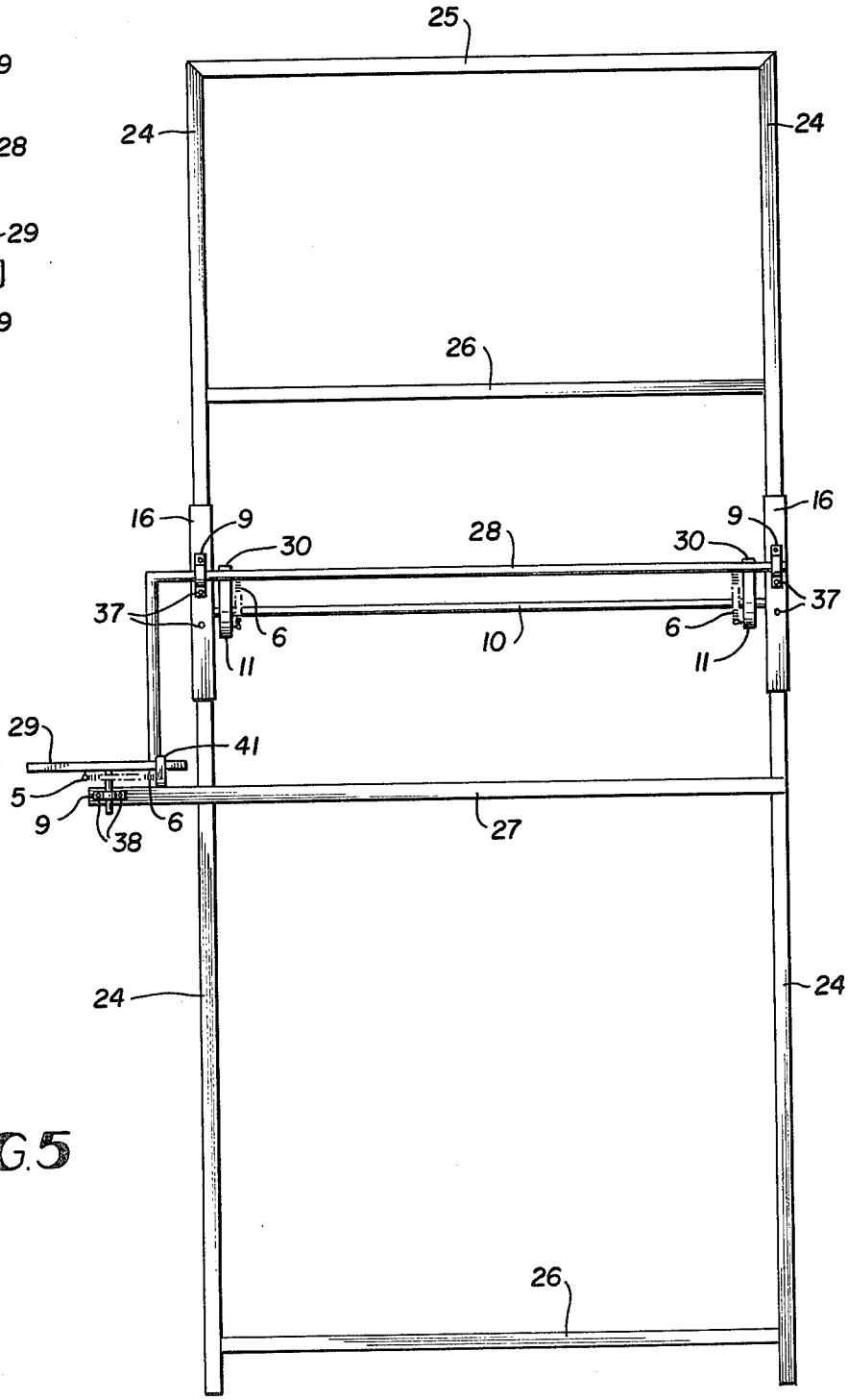
FIG. 5

TARGET APPARATUS

FIELD OF THE INVENTION

The field of the present invention relates generally to amusement devices and systems, and more specifically to such devices and systems that are responsive to a missile such as a ball striking a target for causing a seat or platform to swivel downward, dropping therefrom an object or person sitting upon the seat prior to the missile striking the target.

BACKGROUND OF THE INVENTION

In Gaus, U.S. Pat. No. 1,991,610, a complicated mechanical apparatus is disclosed for dropping a person from a seat into a pool of water upon the striking of a ball or like missile on a target. The mechanism includes a plurality of bevel gears, level arms, rods, and so forth, for concurrent with the seat moving downward to drop the person, causing an animated object to move toward the person as he drops into the water.

In Abraham et al, U.S. Pat. No. 3,262,704, when a target is struck by a missile, a rod having one end connected to the target is moved in a manner for unlatching a mechanism holding, at a height, an animated object, for permitting the object to fall downward via a guided slotway.

SUMMARY OF THE INVENTION

The present invention includes a target mounted upon one end of an elongated and pivotally mounted target arm, whereupon the striking of a missile against the target, the target moves in a direction causing the other end of the target arm to engage and rotate a latching bar means in a direction for releasing latching cam means, in turn causing a seat associated therewith to swivel downward for dropping a person or other object into a water tank, whereafter means are provided for automatically resetting the present apparatus by merely rotating the seat back to its original, upright and latched position.

BRIEF DESCRIPTION OF THE DRAWINGS

The invention will be hereinafter more specifically described with reference to some exemplary embodiments as shown in the drawing wherein like items are indicated by the same reference designation:

FIG. 4 is a detail perspective view, of a portion of the right side of the tripping mechanism;

FIG. 5 is a rear detail view of the invention;

DESCRIPTION OF THE PREFERRED EMBODIMENTS

Figure 2:
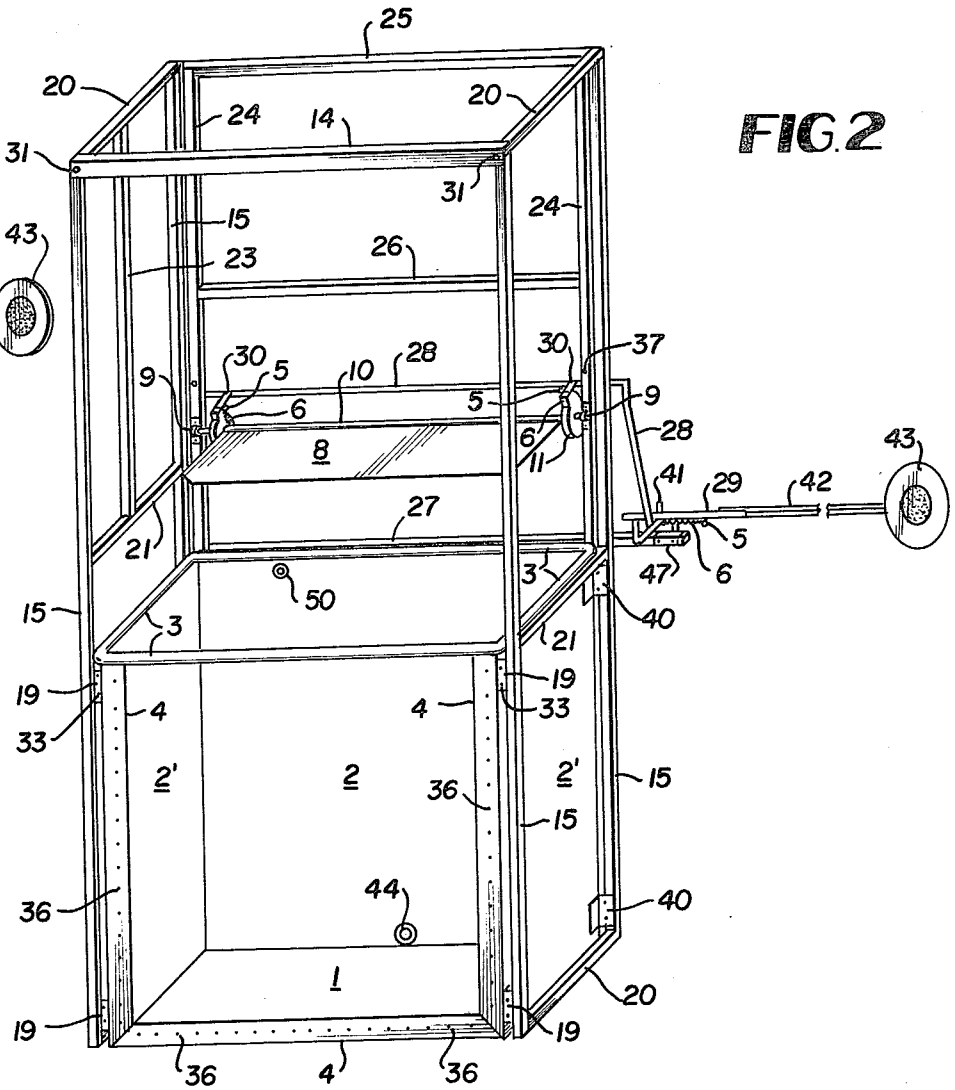
FIG. 2 is a front perspective view, from the right, showing more details than FIG. 1 of certain components.

The present invention was actually reduced to practice by the present invention as shown in the FIGS. 1 through 12, and with reference to Table 1 showing the material and dimensions used for substantially each item. Although specific materials, dimensions, and hardware are indicated in Table 1, such indications are for purposes of example only and not meant to be limiting, in that different dimensions, hardware, and materials may be substituted therefore without deviating from the spirit and scope of the invention.

With reference to FIGS. 1 through 7, and Table 1, the various items of the invention are either welded or bolted together, or otherwise secured. A canopy 45 is provided for shielding a person sitting on seat 8 from the sun, and for cosmetic purposes. Typically, the frame is fabricated from steel tubing and angle iron, for example.

TABLE 1

| REF. NO. | DESCRIPTION | REF. NO. | DESCRIPTION |
|---|---|---|---|
| 1 | 1 ea. @ ⅛" × 48" × 48 " * ALUMINUM | 27 | 1 ea. @ 1½" × 1½" × 16 ga. × 5'0" STEEL TUBE |
| 2 | 1 ea. @ 3/16" × 47 ¾" × 48" * ALUMINUM | 28 | 1 ea. @ 1" dia. × 55" × 17½" STEEL LATCH BAR |
| 3 | 4 ea. @ 1½ dia. × 4'3" * ALUMINUM TUBE | 29 | 1 ea. @ 1" × 1" × 14 ga. × 18" STEEL ANGLE |
| 4 | 3 ea. @ 2½" × 2½" × 3/16" ALUMINUM ANGLE | 30 | 2 ea. STEEL LATCHING TEETH |
| 5 | 4 ea. @ 1" dia. × 2" LONG × ¼" EYEBOLT | 31 | 2 ea. @ ⅜" × 2¼" CAM BOLT, NUT & LOCK WASHER |
| 6 | 4 ea. SPRINGS | 32 | 4 ea. @ ¼" × 1¼" STAINLESS HEX BOLT, NUT, & LOCK WASHER |
| 7 | 2 ea. @ ¼" × 1" × 1" HARDENED STEEL D NOTCH STOPS OR STEPS | 33 | 12 ea. @ 1¼" × 1½" HEX BOLT, NUT, & LOCK WASHER |
| 8 | 1 ea. @ ¼" × 16" × 44" * ALUMINUM SEAT | 34 | 24 ea. @ ¼" × 1¼" STAINLESS STEEL HEX BOLT NUT, & LOCK WASHER |
| 9 | 5 ea. @ 1" BALLBEARING PILLOW BLOCK | 35 | 8 ea. @ ⅜" × 2½" CAM BOLT, NUT, & WASHER |
| 10 | 1 ea. @ 1" dia. × 48" * ALUMINUM BAR | 36 | 68 ea. @ ¼" × 1¼" STAINLESS STEEL HEX BOLT, NUT, & LOCK WASHER |

TABLE 1-continued

| REF. NO. | DESCRIPTION | REF. NO. | DESCRIPTION |
|---|---|---|---|
| 11 | 2 ea. @ 1" × 5½" * ALUMINUM LATCH SPINDLE | 37 | 6 ea. @ ⅜" × 2½" CAM BOLT, NUT, & WASHER |
| 12 | 1 ea. @ 48" × 48" × 236. ACRYLIC PLASTIC (CLEAR) | 38 | 2 ea. @ ⅜" × 2 ¾" CAM BOLT, NUT, & WASHER |
| 13 | 1 ea. @ 47½" × 48" × ½" ACRYLIC PLASTIC (CLEAR) | 39 | 1 ea. @ 3/32" × 2" × 47" * ALUMINUM |
| 14 | 1 ea. @ ¼" × 1½" × 2" × 4'5" STEEL ANGLE | 39' | 2 ea. @ 3/32" × 2" × 45½" * ALUMINUM |
| 15 | 4 ea. @ 1" × 1" × 16 ga. × 9'0" STEEL TUBE | 40 | 8 ea. @ ¼" × 2" × 4" * ALUMINUM ANGLE |
| 16 | 2 ea. @ 1" × 2" × 1" × 16" × ¼" STEEL CHANNEL | 41 | 1 ea. @ ¼" × 3" × 7" × 3" STEEL BRACKET |
| 17 | 4 ea. @ 3" × 3½" × ¼" STEEL WINDOW BRAZE | 42 | 1 ea. @ ¾" × ¾" × 5'0" × 16 ga. TARGET ARM |
| 18 | 4 ea. @ 1" × 1" × ⅛"× 4'0" STEEL ANGLE WINDOW FRAME | 43 | 1 ea. @ 10" dia. × 16 ga TARGET |
| 19 | 8 ea. @ 1" × 1" × ⅛" × 4" STEEL ANGLE FRAME BRACKET | 44 | DRAIN BUSHING (1" TANK ADAPTER) |
| 20 | 4 ea. @ 1" × 1" × 16 ga. × 4'2" STEEL TUBE | 45 | 1 ea. @ 7'6" × 4'6" CANOPY |
| 21 | 3 ea. @ 1" × 1" × 16 ga. × 4'0" STEEL TUBE | 46 | 4 ea. @ ½" × 3/16" COUNTERSUNK BOLT |
| 22 | 8 ea. @ 1" × 2" ⅛" × 4" STEEL ANGLE FRAME BRACKET | 47 | 1 ea. @ 1" × 2" × 1" × 4 ¾" × ¼" STEEL CHANNEL |
| 23 | 1 ea. @ 1" × 1" × 16 ga. × 4½" STEEL TUBE | 48 | 1 ea. @ 1" × 4½" VERTICAL SHAFT |
| 24 | 2 ea. @ 1½" × 1½" × 16 ga. × 9'2" STEEL TUBE | 49 | 1 ea. ALUMINUM LADDER |
| | | 50 | 2 ea. RUBBER BUMPER |
| 25 | 1 ea. @ 1½" × 1½" × 16 ga. × 4'3" STEEL TUBE | 101 | 1 ea. 1" × 3" PIPE NIPPLE |
| 26 | 2 ea. @ 1½" × 1½" × 16 ga. × 47 ¾" STEEL TUBE | 103 | 1 ea. 1" GATE VALUE |
| | | | * 606-T6 TEMPERED ALUMINUM |

Figure 8:
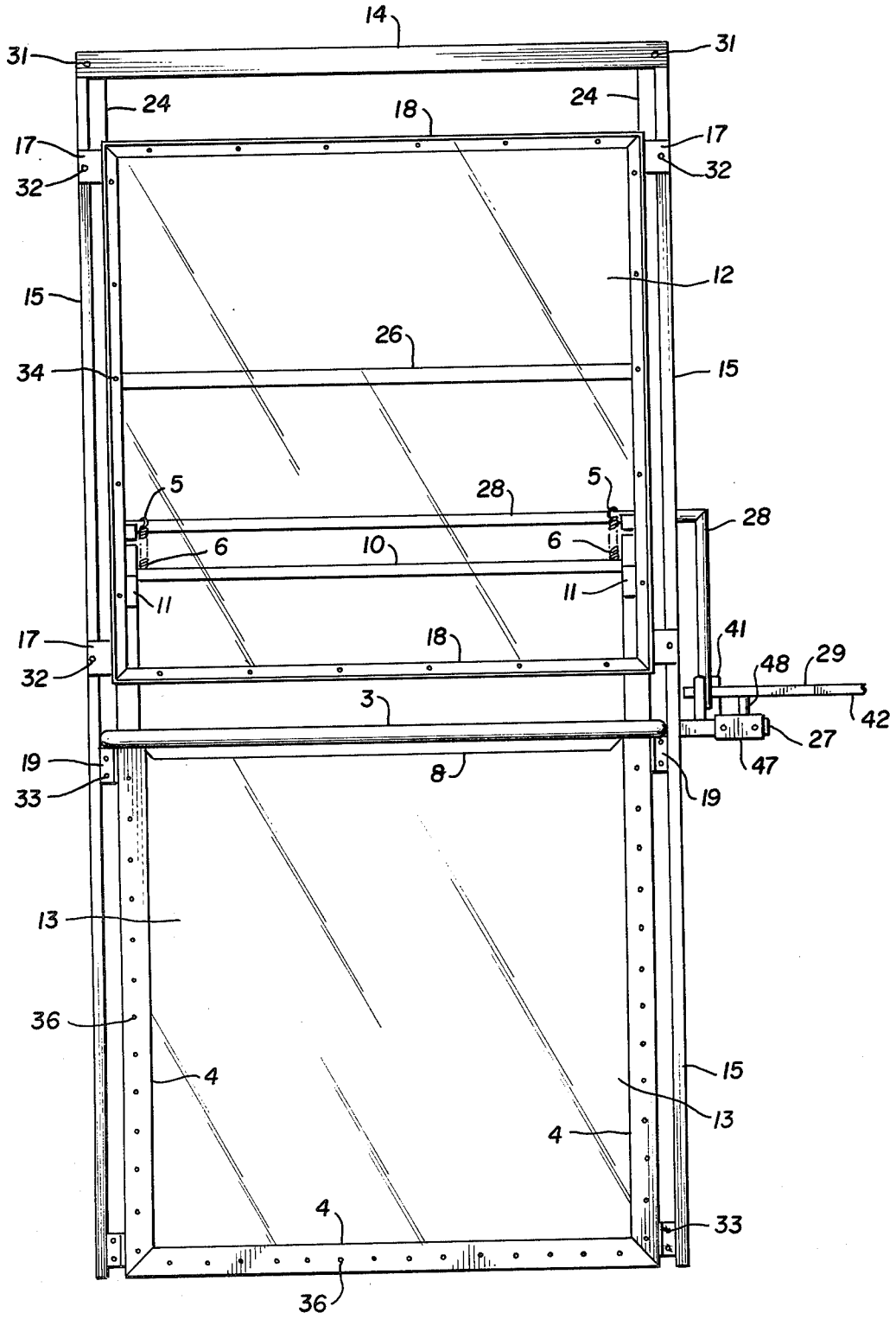
FIG. 8 is a partial detail view, of the front, of the invention.
Figure 9:
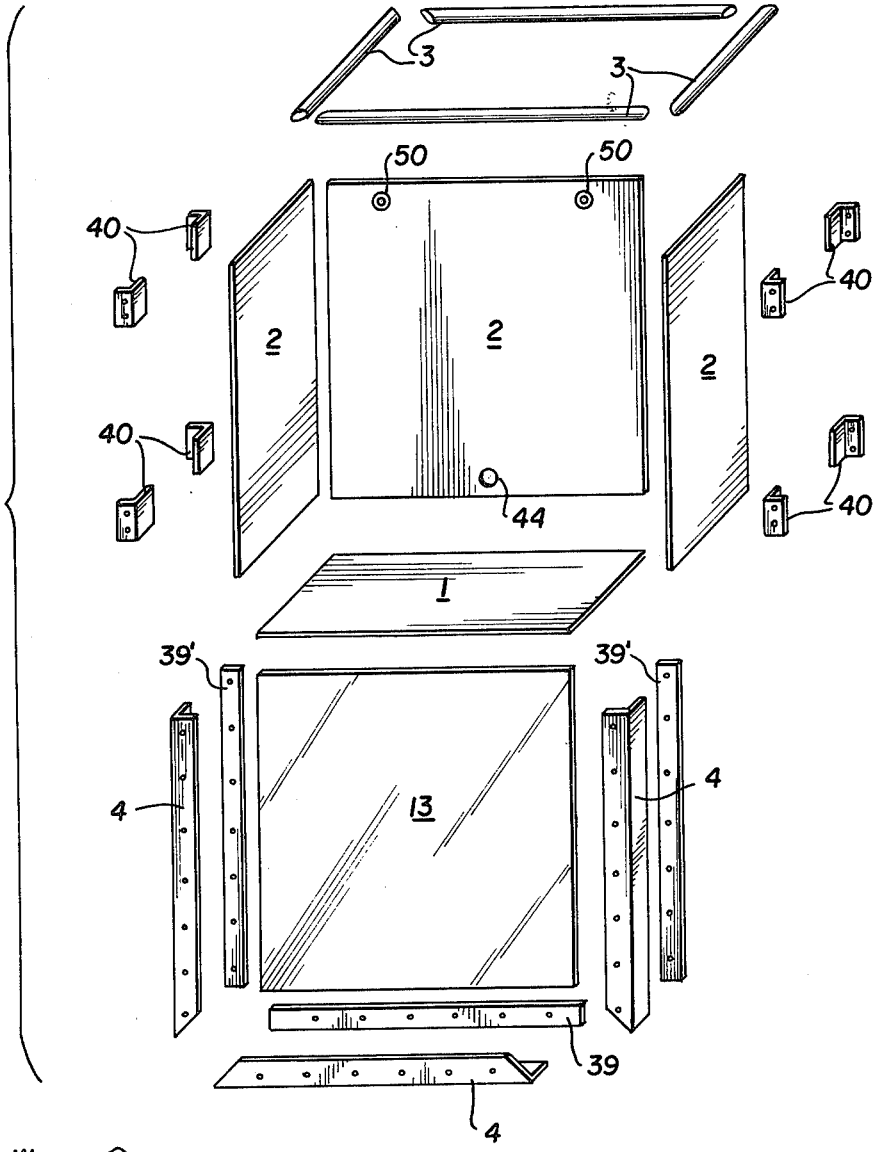
FIG. 9 is an exploded front perspective detail view from the right of the water tank of the invention.
Figure 10:
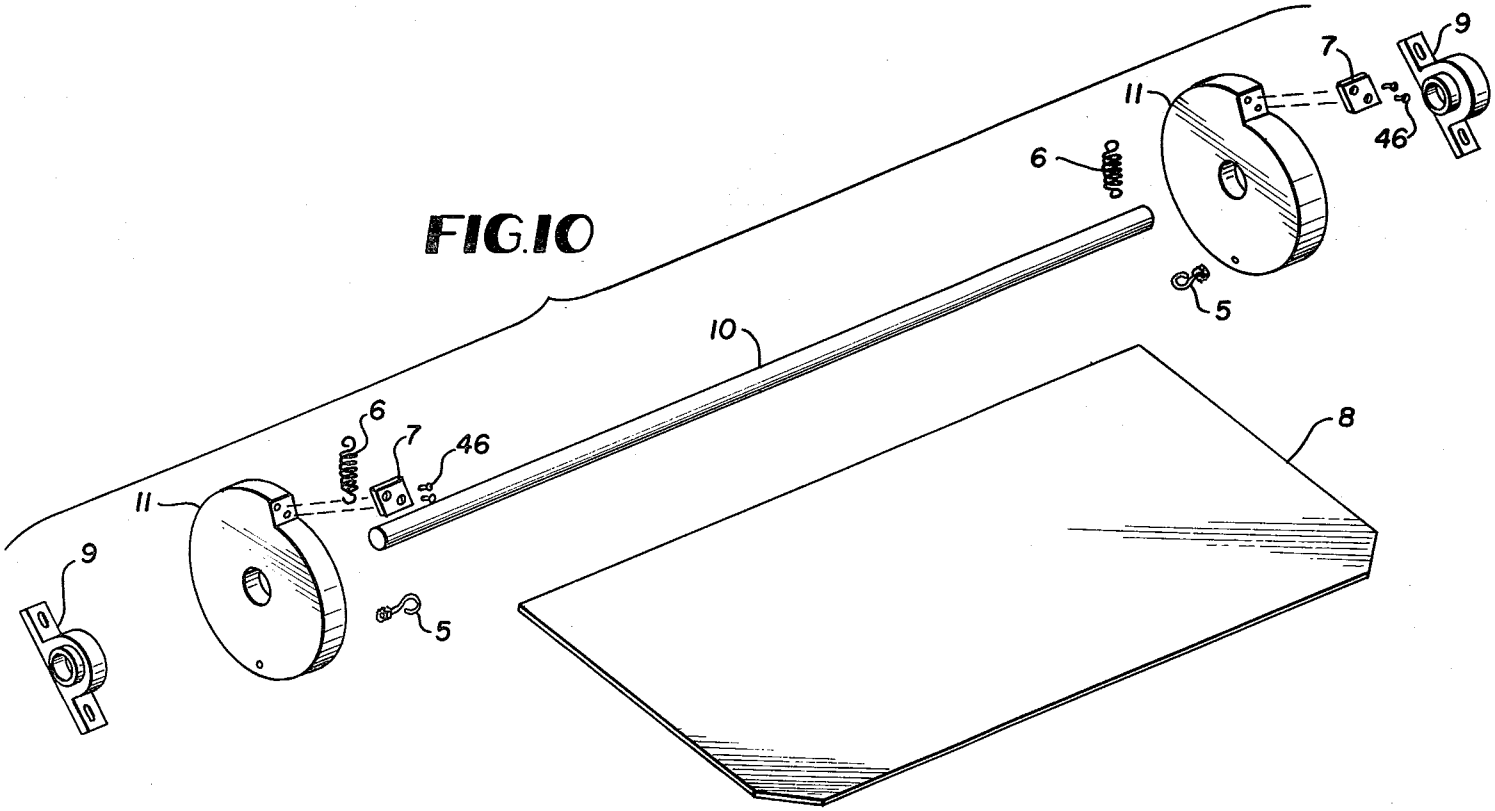
FIG. 10 is an exploded front perspective detail view from the left of a portion of the seat assembly of the invention.
Figure 12:
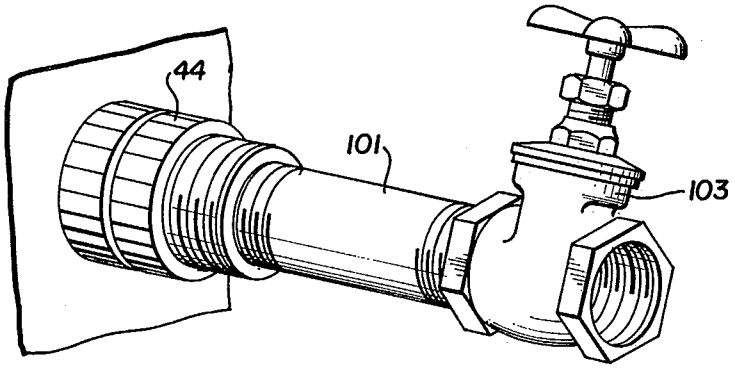
FIG. 12 is a perspective view of the drain assembly for the water tank of the invention.

As shown in FIG. 8, the front of the target apparatus of the invention further includes a clear or transparent shield 12 of acrylic plastic, for example, for protecting a person sitting on seat 8 from being struck by an errant ball or like missile thrown at target 43. One example of a method of mounting the shield 12 is via use of the hardware indicated, including window frame 18 and window brazes 17. Also, the front panel 13 of the water tank (see FIG. 9) is fabricated from a clear or transparent material such as acrylic plastic, for example. The transparent shield 12 and panel 13 permit observers to see a person sitting on the seat 8, and falling into a tank of water subsequent to a missile striking target 43, as will be described. The sides 2' and back 2, and the bottom 1, of the water tank are fabricated from aluminum sheets, and assembled together, as shown in FIG. 9, using aluminum tubing 3, angle 4, struts 39, 39', and angles 40. Appropriate sealing material is used around the seams of the water tank to make it leak proof. A tank adapter 44 is mounted through the back panel of the tank near the bottom panel 1, as shown. FIG. 12 shows a pictorial of the drainage system 44, 101, 103, that protrudes from the outside surface of the back panel 2. Rubber stops 50 are included on the upper inside surface of the back panel 2 for dampening the fall of the seat 8. In FIG. 10, the seat assembly includes a seat 8 welded to a bar 10 (also see FIGS. 2 and 3). The latch spindles 11 are welded to the spindle bar 10 proximate its ends, respectively, as shown. Ballbearing pillow blocks 9 are used to rotationally secure the ends of the spindle bar 10 to the inside surface of the frame 24.

Figure 3:
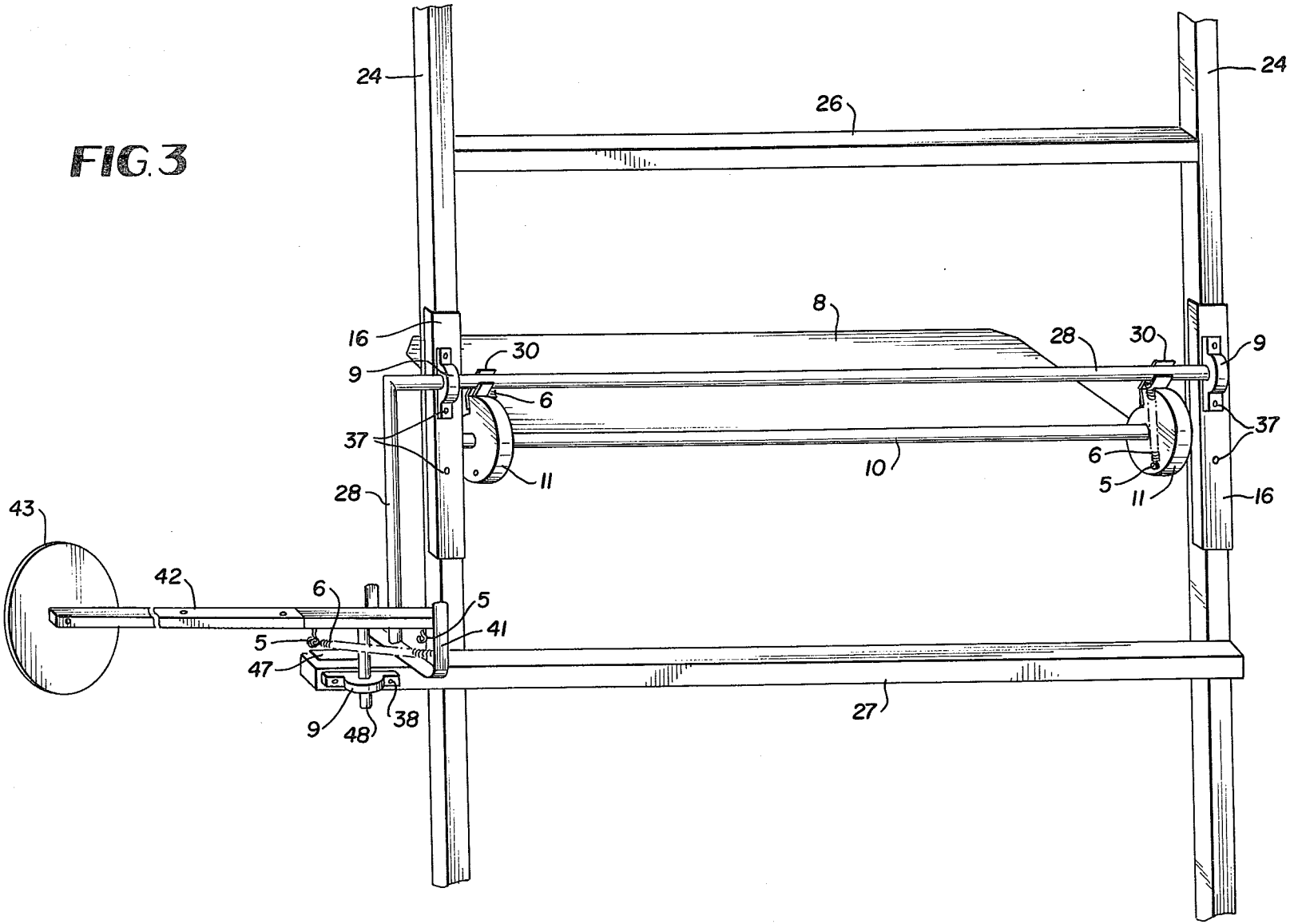
FIG. 3 is a detail perspective view, from the rear, showing the target tripping mechanism and seat asssembly.
Figure 7:
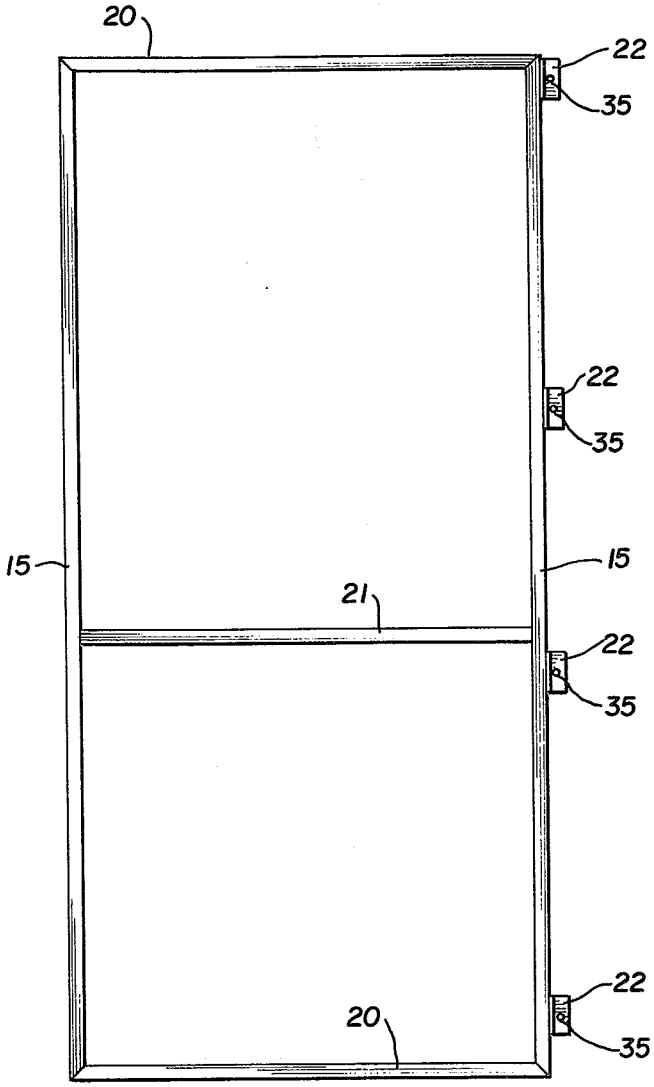
FIG. 7 is a partial detail view, of the right side, of the invention.
Figure 6:
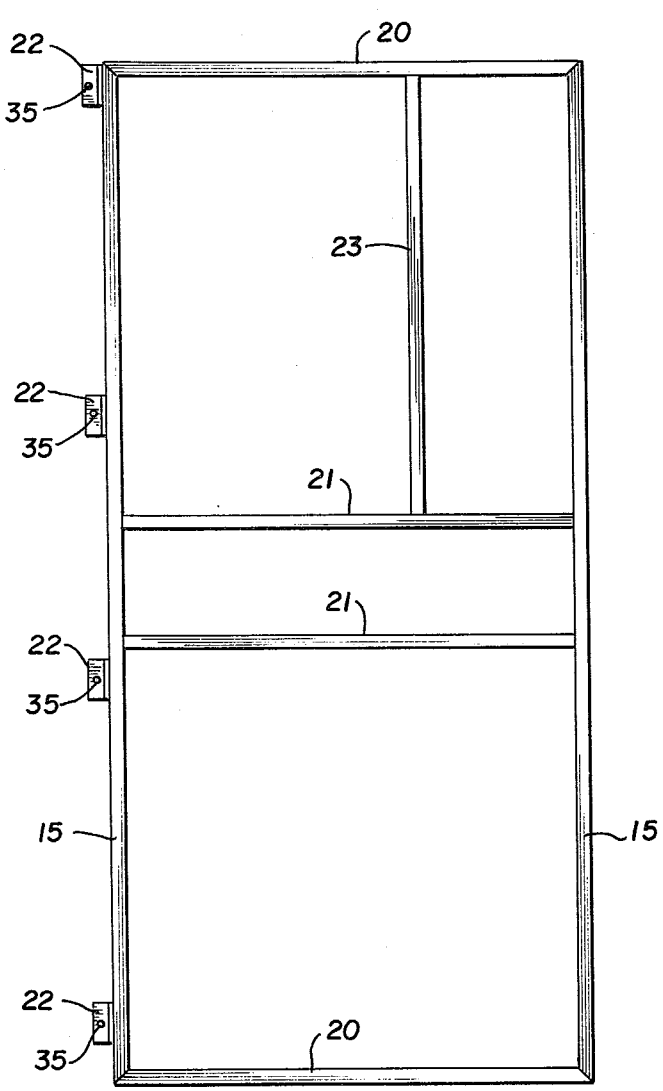
FIG. 6 is a partial detail view, of the left side, of the invention.
Figure 11:
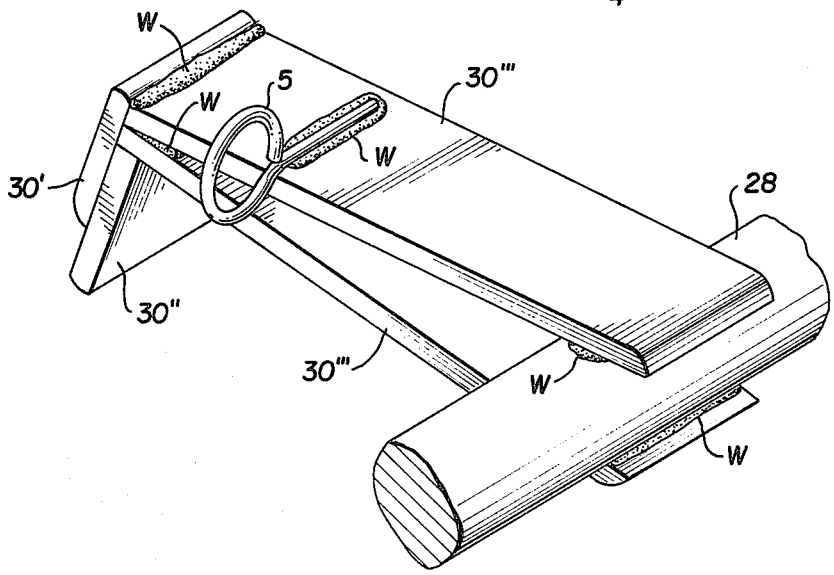
FIG. 11 is a perspective view of the construction of a latching tooth of the invention.

With reference to FIGS. 3 and 11, latch teeth 30 are fabricated from steel members 30', 30'', 30''' via welds W as shown. An eyebolt 5 is welded to one of members 30''' as shown, with the ends of members 30''' being welded to latch bar 28, and positioned as shown.

Figure 1:
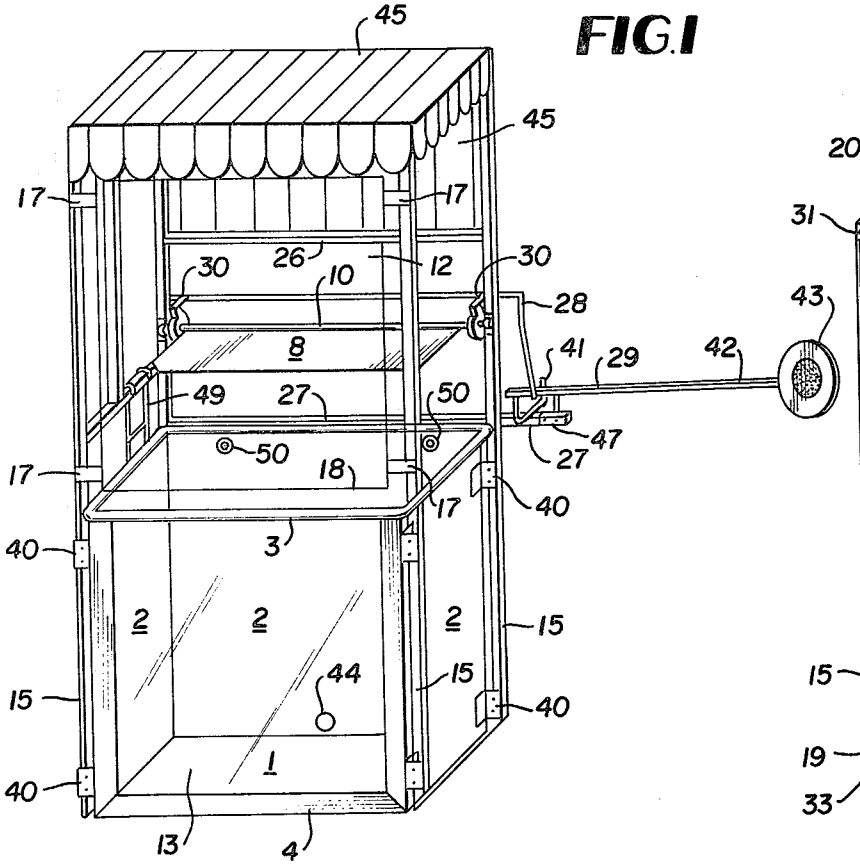
FIG. 1 is a front perspective view, from the right, of a preferred embodiment of the invention.

With reference to FIGS. 1, 2, and 3, a target 43 is rigidly mounted upon an extreme end of a target arm 42. A vertical shaft 48 is rigidly attached to the underside of target arm 42 near the latter's other end, with the end of the shaft 48 being rotationally mounted via a bushing 9 to a protruding end of a cross member 27, as shown. The horizontally aligned portion of latch bar 28 is mounted via bushings or ballbearing pillow blocks 9, and channels 16 to vertical members 24. One end of latch bar 28 is bent at about ninety degrees and oriented as shown for engaging an end portion of target arm 42. A U-shaped bracket 41 is mounted to cross member 27 as shown, for providing a stop means for limiting the movement of target arm 42 and latch arm 28 which are moveable between the upright arms of bracket 41. Springs 6 are mounted between one arm of bracket 41 and eyelets 5 on either side of vertical shaft or pivot arm 48, as shown, for urging target arm 42 against the end of the bent portion or vertically oriented portion of latch arm 28. Other springs 6 are mounted between eyelets 5 attached to latch spindles 11 and their associated latching teeth 30, respectively, for urging the latching teeth 30 against their associated latch spindles 11. Such spring biasing ensures that the latching teeth 30 firmly engage the notch stops 7 (see FIG. 10) of latch spindles 11, respectively, for ensuring that the seat 8 is firmly latched into its upright position in the ready or cocked state of the present target apparatus invention. Also, the combination of the spring biasing of the target arm 42, and latch spindles 11 with associated latch teeth 30, provides for automatic resetting of the apparatus by merely raising the seat 8 to its latched position, as will be described below.

In operation, water is placed in the water tank, and the seat 8 is latched into its upright position as shown in FIGS. 1 through 3. A person climbs a ladder 49 (partially shown in FIG. 1) and sits on seat 8 above the water tank. When a ball or like missile strikes target 43, the associated end of target arm 42 moves back, causing its other end to move foward and rotate latch arm 28 in a direction for lifting the latching teeth 30 away from the notch stops or surfaces 7 of the spindle latches 11, respectively, permitting the seat 8 to swivel downward, dropping the person seated thereupon into the water. The spindle latches 11 will also rotate in the same direction as the seat. When seat 8 so swivels downward or drops it will strike the rubber stops or bumpers 50 mounted on the back of the tank, as previously mentioned. The present target apparatus is thereafter reset by raising up the seat 8 until the latching spindles 11 rotate back to a position permitting the latching teeth 30 to drop down against the notch stops 7, respectively, thereby completing the latching or cocking operation. As the latching teeth 30 so drop into their respective latching positions with their associated latch spindles 11, latch arm 28 is automatically rotated and moves the target arm 42 back into its cocked position. Although particular embodiments of the present invention have been shown and described, other embodiments may occur to those of ordinary skill in the art which fall within the true spirit and scope of the appended claims.

What is claimed is:

1. A missile responsive amusement apparatus comprising:

a target for receiving the striking of a missile;

a box-like frame;

an elongated target arm having said target rigidly mounted to one end, said target arm being pivotally mounted proximate its other end to said frame;

a latch bar mounted for rotation about its axis upon said frame, said latch bar having a protruding bent arm positioned for engaging the other end of said target arm;

at least one latching tooth rigidly attached to one end of said latch bar;

a spindle bar mounted upon said frame for rotation about its axis in a position parallel and proximate to said latch bar;

at least one latching spindle cam rigidly mounted to one end of said spindle bar proximate said latching tooth, said cam including latching means for engaging said latching tooth; and a seat or platform rigidly attached to said spindle bar, said seat being held in an upright position for holding an object in one state of said apparatus via said latching tooth engaging said latching means, whereupon a missile striking said target causes said target to move in a direction for pivotally moving the other end of said target arm in a direction causing rotation of said latch bar via movement of its bent arm for lifting said latching tooth out of engagement with said latching means of said latching spindle cam, thereby permitting said seat to drop downward by gravity via free rotation of said spindle bar, further causing an object initially upon said seat to drop towards the bottom of said apparatus.

2. The apparatus of claim 1, further including:

another latching tooth rigidly attached to the other end of said latch bar; and another latching spindle cam mounted upon the other end of said spindle bar proximate said another latching tooth, said another cam including means for engaging said another latching tooth in a manner similar to that between said one cam and one latching tooth.

3. The apparatus of claim 1 wherein said latching means includes a notch-like step in the circumference of said one spindle cam; and said one latching tooth includes a pawl-like projection for engaging said notch-like step.

4. The apparatus of claim 2 wherein the latching means of said one and another latching spindle cams each include a notch-like step in the circumferences of said cams, respectively; and said one and another latching teeth include a pawl-like projection for engaging their respective or associative notch-like steps.

5. The apparatus of claims 1, or 2, or 3, or 4, further including stop means mounted upon said frame for limiting the pivotal movement of said target arm between extremes in either direction.

6. The apparatus of claim 5 wherein said stop means consists of a U-shaped member having a pair of opposing arms between which the other end of said target arm is located, said opposing arms serving as stops for limiting movement of said target arm.

7. The apparatus of claims 1, or 2, or 3, or 4, further including spring biasing means for substantially holding a portion of the bent arm of said latch bar against a portion of said target arm near its other end.

8. The apparatus of claim 1, further including spring biasing means mounted between said latching spindle cam and associated latching tooth, for holding the latter two in close engagement, thereby ensuring that said seat is held upright until such time that a missile strikes said target.

9. The apparatus of claims 2, 3, or 4, further including spring biasing means for ensuring close and positive engagement between said one and another latching teeth, and said latching means of said one and another latching spindle cams, respectively, thereby ensuring an uprightly held seat until such time that a missile strikes said target.

10. The apparatus of claim 1 further including:

a pivot arm rigidly attached to said target arm near its other end; and a bushing-like bracket mounted upon said frame for receiving the free end of said pivot arm in a manner permitting free rotation of said pivot arm abouts its axis.

11. The apparatus of claims 1, 2, 3, or 4, further including:

means enclosing a lower portion of said box-like frame, for providing a water tank below said seat.

12. The apparatus of claim 11 wherein said enclosing means includes a front transparent panel for permitting the observation of an object falling into the water tank upon the dropping of said seat.

13. The apparatus of claim 12, further including means located in a lower portion of a wall of said water tank, for draining water from said tank.

14. The apparatus of claim 12, further including said box-like frame being open above said water tank at its right and left sides, and back portions.

15. The apparatus of claim 14, further including a ladder mounted on the side of said box furthest from said target, for permitting a person access to said seat for sitting upon or placing an object thereupon when it is in the latched or upright position.

16. The apparatus of claim 4, further including:

first spring biasing means for urging said bent arm of said latch bar against said other end of said target arm; and second spring biasing means for urging said one and another latching teeth into engagement with the notch-like steps of said one and another latching spindle cams;

said first and second spring biasing means further ensuring that when said seat is raised from its lowered to its upright position, that automatically said one and another latching spindle cams engage said one and another latching teeth, for holding said seat upright, concurrent with said target returning to a "cocked" or "ready" position for receiving the next missile.

17. The apparatus of claims 1, or 2, or 3, or 4, further including a canopy across the top of said box-like frame for shading a person sitting upon said seat.

18. The apparatus of claim 12 wherein another front transparent panel mounted upon said frame extends between substantially the top front edge of said tank and the top of said frame-like box, for protecting an object or a person sitting upon said seat from being struck by errantly traveling missiles, while permitting observation thereof by outside observers.

19. A missile responsive amusement apparatus comprising:

a target for striking by missiles;

an elongted target arm having said target mounted upon one end, said target arm being mounted proximate its other end for pivotal movement in a horizontal plane in response to a missile striking said target;

stop means for limiting the pivotal movement of said target arm in either direction;

a substantially box-like frame having an intermediately located horizontal cross-member rigidly attached between left and right hand vertical support members forming the back of said box-like frame, said cross-member having one end protruding from said frame, said elongated target arm and stop means being mounted upon said protruding end;

a latch bar captively and rotationally mounted horizontally between the left and right hand support members above said cross-member, said latch bar having one end portion protruding from said frame and bent at ninety degrees from the captively held portion, said one end being located for interacting with the other end of said target arm;

a spindle bar rotationally mounted horizontally between said left and right hand support members, and positioned between said cross-member and latch bar;

a pair of latching spindle cams rigidly mounted proximate each end of said spindle bar, each cam having a notch-like portion;

a pair of pawl-like latching teeth 30 rigidly mounted upon said latch bar, each being located for individually engaging the notch-like portions of said pair of spindle cams, respectively;

first spring biasing means mounted between each one of said latching teeth and a transverse face of said associated spindle cams, respectively, for ensuring positive engagement therebetween;

a seat rigidly attached to said spindle bar, and adapted for supporting, in one state of said apparatus, an object within said box-like frame;

second spring biasing means mounted between said stop means and said target arm, for biasing the other end of said target arm against a portion of said latch bar proximate its bent end;

the lower portion of said box-like frame below said seat being fully enclosed by panels for forming a water-tight tank for holding water, the front panel forming said tank being of clear or transparent material, the upper sides and back portions of said box-like frame being open above said tank, a clear panel covering the front of said frame above said tank for protecting objects on said seat from striking by errantly traveling missiles, whereby in said one-state of said apparatus said latching teeth engage the notches of their respective spindle cams for holding the seat in an upright position for supporting an object above said water tank, and upon a missile striking said target, said target arm pivots in a direction causing its other end to rotate said latch bar in a direction for rotating said pair of latching teeth out of engagement with the notches of said spindle cams, respectively, permitting said spindle bar to rotate for dropping said seat, thereby causing said object to fall into the water tanks, said apparatus being resettable via rotation of said seat back to its upright position, thereby causing said locking teeth to engage said notches of said spindle cams, and said target arm to be returned via rotation of said latch bar to the "ready position".

20. The apparatus of claim 19, further including a canopy for covering the top of said box-like frame.

21. The apparatus of claim 19, further including means mounted in a lower wall portion of said tank for draining water therefrom.

* * * * *